US005863040A

United States Patent [19]

Van Gass

[11] Patent Number: 5,863,040

[45] Date of Patent: Jan. 26, 1999

[54] GAME COMPRISING A PACK OF CARDS

[75] Inventor: Roderich Rive Van Gass, Mount Hawthorn, Australia

[73] Assignee: Idea Shop, Ltd., Tortola, Virgin Islands (Br.)

[21] Appl. No.: 950,460

[22] Filed: Oct. 15, 1997

[51] Int. Cl.[6] ..... A63F 1/00

[52] U.S. Cl. ..... 273/292; 273/306

[58] Field of Search ..... 273/303–306, 273/307, 308, 292

[56] References Cited

U.S. PATENT DOCUMENTS

| | | | |
|---|---|---|---|
| 869,302 | 10/1907 | Healy | 273/303 |
| 1,215,657 | 2/1917 | Hicks | 273/304 |
| 2,540,211 | 2/1951 | O'Keefe | 273/292 |
| 5,467,997 | 11/1995 | Bashirzadeh | 273/302 |
| 5,697,616 | 12/1997 | Wilyard | 273/303 |

FOREIGN PATENT DOCUMENTS

| | | | |
|---|---|---|---|
| 285610 | 2/1928 | United Kingdom | 273/304 |
| 2058583 | 4/1981 | United Kingdom . | |
| 2286131 | 8/1995 | United Kingdom . | |

*Primary Examiner*—Benjamin H. Layno
*Attorney, Agent, or Firm*—Eckert Seamans Cherin Mellott

[57] ABSTRACT

In a pack of cards for playing a game, each of the cards (10) has on it a first marking (11), a second marking (12) and a third marking (13), each of the said markings being separately selected from at least a first variant, a second variant and a third variant, the variants of each of the said markings being distinguishable from the variants of the said markings and the variants being ranked in a cyclic order of superiority. At least some of the cards have different permutations of variants for the said markings from other cards. The pack is used in playing various games involving the variants of the markings and selecting non-matching pairs according to certain rules.

8 Claims, 1 Drawing Sheet

GAME COMPRISING A PACK OF CARDS

BACKGROUND TO THE INVENTION

The present invention relates to a game comprising a pack of cards.

A game is known in which two players simultaneously display a symbol selected from three different symbols A, B, and C, where it is agreed that symbol A is superior to symbol B and symbol B is superior to symbol C but symbol C is superior to symbol A, the winner being the one who displays the superior symbol (draws occurring if both display the same symbol). One example of such a game is where the symbols A, B and C are identified as "scissors", "paper" and "stone", "scissors" cutting "paper" and thus being superior to it, "paper" wrapping "stone" and thus being superior to it, but "stone" blunting "scissors" and thus being superior to it.

SUMMARY OF THE INVENTION

The present invention seeks to provide an improved and extended form of such a game to be played by two or more players, using a pack of cards.

According to the invention there is provided a game comprising a pack of cards, each of the cards having on it a first marking, a second marking and a third marking, each of the said markings being separately selected from a plurality of mutually distinguishable variants, wherein the variants are ranked in a cyclic order of superiority and at least some of the cards have different combinations of variants for the said markings from other cards.

The expression "ranked in a cyclic order of superiority" means, for example, that the first variant is superior to the second variant, the second variant is superior to the third variant and the third variant being superior to the first variant, assuming there to be only three variants. If the markings are identified as A, B, C etc and the variants as 1, 2, 3 etc then the superiority relationship may be identified as follows

A.1>A.2>A.3 . . . >A.1

B.1>B.2>B.3 . . . >B.1

C.1>C.2>C.3 . . . >C.1 where > means "is superior to" and the dots indicate the optional presence of one or more additional variants and/or one or more additional markings. (The use of only two variants and/or only two markings is feasible but the resulting game is less challenging and consequently less interesting.)

Preferably, there are only three markings on each card, each marking being selected from three variants. In this embodiment there are 27 different combinations of the variants of the three markings, ranging from A.1+B.1+C.1 through for example A.1+B.2+C.3 and A.3+B.1+C.2 to A.3+B.3+C.3, using the notation employed above. Preferably, the pack includes at least one card of each of these combinations and it makes for a longer and more interesting game if there are two or even three identical examples of each of these 27 cards, making 54 or 81 cards in the pack.

The variants of each individual marking are advantageously easily recognisable and readily rankable in a cyclic order of superiority. A very convenient way of providing the variants is to use different colors, for example red, yellow and blue (although other colors such as green, black, white etc could be used additionally or instead). These colors may be ranked in any order which is agreed upon before the start of the game, for example red is superior to yellow, which is superior to blue, which is superior to red. This ranking is conveniently displayed on one or more additional cards forming part of the pack.

The markings may at their simplest be different areas of the card having boundaries, although it would be possible to have drawings, pictures or the like, assuming that each card has the same three (or more) drawings or pictures, differing only in the allowed variants. Each of the three markings on any card should preferably be differentiated clearly in appearance, positioning or some other way from the other markings on that card. Preferably, the markings are so shaped and arranged that they are distinguishable irrespective of the direction from which the displayed card is viewed. A simple and convenient differentiation and arrangement of markings is achieved by forming the first marking as a central rectangular area on the usually rectangular card, forming the second marking as an inner hollow rectangular area surrounding the central rectangular area and forming the third marking as an outer hollow rectangular area surrounding the inner hollow rectangular area.

DETAILED DESCRIPTION OF THE PREFERRED EMBODIMENT

Figure 1:
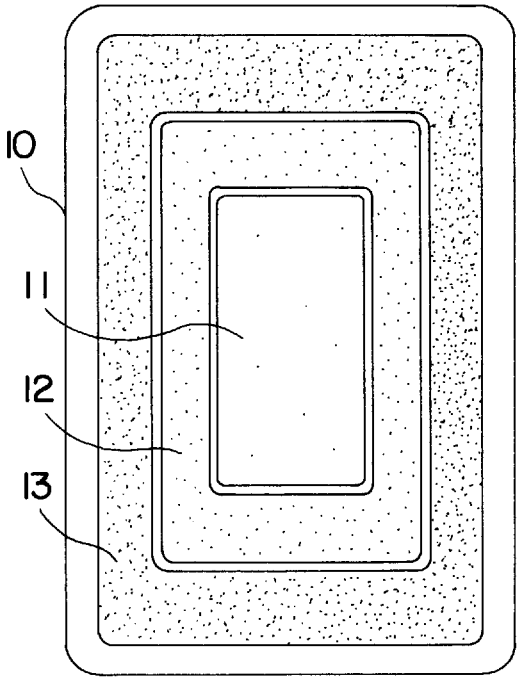
FIG. 1 shows a card used in an embodiment of the invention.

One particular embodiment of the invention is a pack of 81 cards each having three markings as shown in FIG. 1, where 10 denotes the card, 11 the first marking, 12 the second marking and 13 the third marking. The areas 11, 12 or 13 are colored red, yellow or blue and there are three cards in each of the 27 permutations as follows:

| Area 11 | Area 12 | Area 13 |
|---|---|---|
| Red | Red | Red |
| Red | Red | Yellow |
| Red | Red | Blue |
| Red | Yellow | Red |
| Red | Yellow | Yellow |
| Red | Yellow | Blue |
| Red | Blue | Red |
| Red | Blue | Yellow |
| Red | Blue | Blue |
| Yellow | Red | Red |
| Yellow | Red | Yellow |
| Yellow | Red | Blue |
| Yellow | Yellow | Red |
| Yellow | Yellow | Yellow |
| Yellow | Yellow | Blue |
| Yellow | Blue | Red |
| Yellow | Blue | Yellow |
| Yellow | Blue | Blue |
| Blue | Red | Red |
| Blue | Red | Yellow |
| Blue | Red | Blue |
| Blue | Yellow | Red |
| Blue | Yellow | Yellow |
| Blue | Yellow | Blue |
| Blue | Blue | Red |
| Blue | Blue | Yellow |
| Blue | Blue | Blue |

Figure 2:
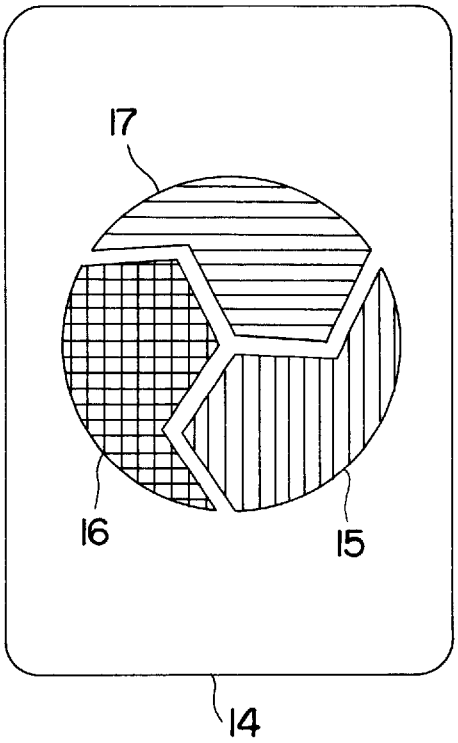
FIG. 2 shows an additional and optional card.
Figure 3:
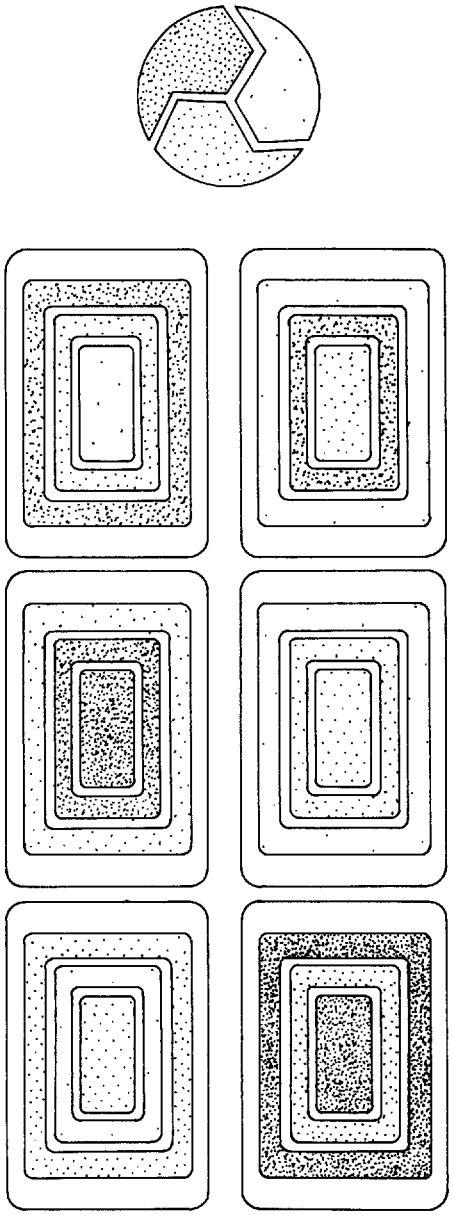
FIG. 3 shows an arrangement of pairs of cards in which each card on the left hand side is superior to the respective card on the right hand side.

The pack of cards conveniently includes additional cards serving to remind players of the ranking of the variants. An example of such a card is shown as 14 in FIG. 2, with the areas 15, 16, 17 being colored red, yellow and blue respectively to show that red is superior to yellow, yellow is superior to blue and blue is superior to red. The drawing further includes examples of pairs of cards where the variant of each marking on the first card is superior to the variant of each corresponding marking on the second card.

The cards are suitable for playing a variety of games on the same theme. Rules for playing some games identified by the trade mark GAWP are set out below.

RULES

INTRODUCTION

GAWP is an absorbing and fascinating game in which players must exercise their little-used skills of pattern matching and color recognition to pick out groups of cards as defined by the rules below. EVERYONE PLAYS AT ONCE, so you are in a race to spot the right cards and claim them for yourself. The rules for SUDDEN DEATH GAWP and GAWP SOLITAIRE 1 & 2 are outlined at the end of these rules.

BASIC IDEA—The Main Game

Cards are laid out on the table in a grid of 15 (3×5). Each card has three rectangles on it called Outer, Middle and Inner. You must look for pairs of cards in which ALL of the rectangles on one card defeat the same rectangles on the other. No draws are allowed. The combat system is outlined on the cards with circular design (red beats yellow, yellow beats blue and blue beats red). These cards are provided to help you whilst learning. The circular combat system is unique to GAWP.

HOW TO PLAY—BASIC GAME

All players sit close around the playing surface. Select a dealer for the first game, for each subsequent game the deal passes to the right. The dealer will normally play, however when all players are very good, the dealer is at a disadvantage and may chose not to play that game.

Shuffle the cards VERY THOROUGHLY. Deal out a grid 5 cards by 3 cards (15 cards total). Players all look at the cards trying to spot PAIRS.

A pair exists where EACH of the Outer, Middle and Inner rectangles on one card beats the same rectangles on the other. See below for explanation of combat rules.

As soon as a player spots a pair they say GAWP! They now have exclusive access to the cards to immediately pick up the pair they have seen. As long as the pair is correct they keep them. The number of cards you collect is your score, the highest wins once the deck is all dealt.

IF YOU CALL A FALSE GAWP and you can't pick up a correct pair immediately, you must give a card from your collected pairs to the dealer who puts it randomly into the deck before continuing. If you have no collected cards there is no other penalty.

When a pair is picked up, the dealer replaces the two missing cards, and play continues AS SOON as the new cards have been laid down.

WINNING

After the whole deck has been dealt and all pairs picked up the person with most cards wins.

COMBAT EXPLAINED

If you look at the cards with a circular design you will see three colors with arrows going round the circle from one to the next. The arrows show that RED beats YELLOW, YELLOW beats BLUE and BLUE beats RED.

For example a card with Outer(O)-RED(R), Middle(M)-BLUE(B) and Inner(I)-RED(R) will beat a card with outer (O)-YELLOW (Y), Middle(M)-RED(R) and Inner(I)-YELLOW (Y). An example is outlined below using these initials to make it shorter and clearer. O-Y, M-R, I-R beats O-B, M-Y, I-Y OR IS BEATEN BY O-R, M-B, I-B, so two pairs are possible with each card, one pair with a card that IT BEATS and ANOTHER PAIR with a card that BEATS IT.

DON'T PANIC

Now this might seem pretty complicated, but in fact it's not, BECAUSE you will soon find that various arrangements of colors automatically win, whilst others don't. You won't need to refer constantly to the color circle for a reminder. For example O-Y, M-R, I-Y CANNOT BEAT the same colors reversed on another card, O-R, M-Y, I-R, even though this looks like a very appealing pair.

THE ADVANCED GAME—HOW TO PLAY

Once you have become good at spotting pairs you move on to the full game, spotting threes. A three consists of; card A beats card B, just as in the BASIC GAME, but ALSO card B beats card C, which, because of the circular combat system automatically beats card A. Simple isn't it? NO, well give it a try.

For the ADVANCED game you need another row of cards to make a total of 20 (4 cards×5 cards).

As with the BASIC game, a player calls GAWP to get exclusive access to the cards, BUT if a false call is made you must give 2 cards back to the dealer. If you have no cards no other penalty applies.

The player with the highest number of cards collected at the end of the deck and after all threes are picked up, wins.

SUDDEN DEATH GAWP

This is an exciting game for two to six players.

Shuffle the pack VERY THOROUGHLY and deal the whole deck out to the players. If some players have one card more than others it doesn't matter.

Players hold their cards in a pack, face down and take it in turns to lay a card face up on the table in front of them, each building their own pile. Each round each player puts a new card on top of their last one, making a pile with a card face-up on top.

Every time a card is put down the player who lays it down checks to see if it makes a PAIR, as described in the BASIC GAME. with the top card on any other pile, and the other players check if the newly laid card makes a pair with THEIR top card. The first player to shout GAWP gets to pick up the WHOLE PILE with the paired card on top.

If they make a false call, they must give their existing pile to the person who placed the last card. If the person placing the last card makes a false call, they must deal their existing pile round to all the other players. This may not give each player exactly the same number, but that doesn't matter.

The game finishes when the first player runs out of cards, or all cards are on the table in piles and there is no PAIR visible. The player with the most cards wins.

We tried playing this with threes instead of pairs, but threes come up so rarely that it wasn't worth the effort.

GAWP SOLITAIRE 1 & 2

This can be played two ways:

1) First, just like the BASIC or ADVANCED games, looking for pairs or threes in a grid of cards on the table, or
2) Second, hold the whole pack face down and deal four cards up in a row. Now deal out four more on top of the first four in a slow steady rhythm. You must spot the pairs before you cover them up. Every time you spot a pair, pick up the two cards and place them to the side. You can always win in time, but it's the time that counts. The faster you can PAIR out the whole deck the better you are.

Although the invention has been described in terms of a pack of cards, it will be appreciated that the same principle can be applied to a computer game in which the markings and variants are images in areas on a computer screen such that pairs and threes can be matched in a similar way. The pack of cards is therefore a set of virtual "cards" in such an embodiment and the computer game includes means for generating the images of the virtual cards and means for marking and/or removing the virtual cards in twos or threes when they have been selected as well as means for displaying a plurality of the images simultaneously.

It will be appreciated that further modifications can be made without departing from the spirit and scope of the invention. For example, the same principle can also be applied to a board game, for example a board game employing a board having markings corresponding to cards in the pack of cards or able to have such markings.

I claim:

1. A game comprising a pack of cards, each of the cards having on it a first marking, a second marking and a third marking, each of the said markings being separately selected from a plurality of mutually distinguishable variants, including first, second and third mutually distinguishable variants wherein the variants are ranked in a cyclic order of superiority such that the first variant of each of the said markings is superior to the second variant, and the second variant is superior to the third variant but the third variant is superior to the first variant and at least some of the cards have different permutations of variants for the said markings from other of the cards.

2. The game as claimed in claim 1, including 27 different cards, one for each different permutation of the said first, second and third variants of each of the said first, second and third markings.

3. The game as claimed in claim 1, wherein the variants of each of the said markings are variants in color.

4. The game as claimed in claim 1, wherein the markings consist of areas of the card having boundaries.

5. The game as claimed in claim 4, wherein the areas are a central area forming the first marking, an inner hollow area surrounding the central area and forming the second marking and an outer hollow area surrounding the inner hollow area and forming the third marking.

6. The game as claimed in claim 5, wherein the areas are rectangular areas.

7. The game as claimed in claim 1, wherein said cards are provided as images on a computer screen.

8. The game as claimed in claim 1 also including one or more additional cards indicating which of said variants is superior to which other of said variants.

* * * * *